US007291389B1

(12) United States Patent
Bitler et al.

(10) Patent No.: US 7,291,389 B1
(45) Date of Patent: Nov. 6, 2007

(54) ARTICLE HAVING TEMPERATURE-DEPENDENT SHAPE

(75) Inventors: Steven P. Bitler, Menlo Park, CA (US); Edward E. Schmitt, Palo Alto, CA (US); Quiang Zheng, Palo Alto, CA (US)

(73) Assignee: Landec Corporation, Menlo Park, CA (US)

( * ) Notice: Subject to any disclaimer, the term of this patent is extended or adjusted under 35 U.S.C. 154(b) by 329 days.

(21) Appl. No.: 10/777,520

(22) Filed: Feb. 12, 2004

Related U.S. Application Data

(60) Provisional application No. 60/447,378, filed on Feb. 13, 2003.

(51) Int. Cl.
*B32B 7/02* (2006.01)
*B65B 53/00* (2006.01)
*D02G 3/00* (2006.01)

(52) U.S. Cl. ..... 428/373; 428/34.9; 428/212; 428/364; 428/370; 428/374; 442/362; 442/364; 57/244; 57/238; 264/173.16

(58) Field of Classification Search ..... 428/364, 428/370, 373, 374, 34.9, 22; 57/244, 238; 264/173.16; 442/362, 364
See application file for complete search history.

(56) References Cited

U.S. PATENT DOCUMENTS

| | | | | |
|---|---|---|---|---|
| 5,133,917 | A | 7/1992 | Jezic et al. | 264/210.8 |
| 5,487,943 | A | 1/1996 | Kozulla | 428/373 |
| 5,582,667 | A | 12/1996 | Gupta et al. | 156/148 |
| 5,762,734 | A | 6/1998 | DeLucia | 156/73 |
| 5,972,502 | A | 10/1999 | Jessee et al. | 428/370 |
| 6,388,043 | B1 | 5/2002 | Langer et al. | 528/80 |
| 6,395,392 | B1 | 5/2002 | Gownder | 428/370 |
| 6,420,285 | B1 | 7/2002 | Newkirk et al. | 442/364 |
| 6,723,669 | B1 * | 4/2004 | Clark et al. | 442/347 |

OTHER PUBLICATIONS

JP 8-311716 machine translation date May 22, 2006.*

* cited by examiner

*Primary Examiner*—Rena Dye
*Assistant Examiner*—Lawrence Ferguson
(74) *Attorney, Agent, or Firm*—Jeffrey G. Sheldon; Sheldon Mak Rose & Anderson PC

(57) ABSTRACT

Articles, particularly fibers, whose shape is dependent on temperature. The articles have a first component composed of a sharply-melting crystalline polymer and an overlapping second component. As the crystalline polymer is cooled through its melting range, the volume of the first component increases much more rapidly than the volume of the second component. As a result, the shape of the article changes. Such fibers can be incorporated into fibrous articles having temperature-dependent thermal insulation properties.

18 Claims, No Drawings

ARTICLE HAVING TEMPERATURE-DEPENDENT SHAPE

CROSS-REFERENCE TO RELATED APPLICATION

This application is related to, and claims the benefit of the earlier filing date of, provisional application No. 60/447,378, filed Feb. 13, 2003. The entire disclosure of that provisional application is incorporated by reference herein for all purposes.

BACKGROUND OF THE INVENTION

1. Field of the Invention

This invention relates to polymeric articles whose shape depends on temperature.

2. Introduction to the Invention

It is known to make polymeric articles, for example fibers, whose shape depends on temperature. Many such articles comprise overlapping components which are composed of different polymeric compositions. The polymeric compositions and the components are chosen so that, as the ambient temperature changes over a particular temperature range, forces generated within the components change the shape of the article. Articles of this type in which there are two components can be referred to as bicomponent or biconstituent articles. Reference may be made for example to U.S. Pat. Nos. 5,133,917 (Jezic et al.), 5,487,943 (Kozulla), 5,582,667 (Gupta et al.), 5,972,502 (Jessee et al), 6,388,043 (Langer et al.), 6,395,392 (Gownder) and 6,420,285 (Newkirk et al), the disclosures of which are incorporated herein by reference.

SUMMARY OF THE INVENTION

This invention relates to the use of certain crystalline polymers in articles whose shape depends on temperature. The crystalline polymers in question have (a) a peak melting temperature $T_p$ which is at least −40° C., for example at least −20° C., and at most 120° C., for example at most 100° C. or at most 50° C., (b) an onset of melting temperature $T_o$ such that $(T_p-T_o)$ is less than $$(-1.7757e^{-5})\times(T_p^3)+(3.339e^{-3})\times(T_p^2)-(6.977e^{-2})\times(T_p)+k,$$

where k is 21, preferably 16, particularly 11, and (c) a heat of fusion of at least 5 J/g.

In a first aspect, the invention provides an article which comprises (1) a first component composed of a first polymeric composition, the first polymeric composition comprising a crystalline polymer as defined above, and (2) a second component which (a) is composed of a second composition, for example a polymeric composition, and (b) overlaps the first component;

the first polymeric composition having a volume expansion between $T_o$ and $T_p$ which is greater than the volume expansion of the second composition over the same temperature range, and the first and second components having dimensions and shapes such that the article, in the absence of external restraint, changes shape when it is heated from $T_o$ to $T_p$ and when it is cooled from $T_p$ to $T_o$. In one embodiment, the article is a fiber having the first component principally on one side of the fiber so that, as the first component expands or shrinks, it exerts a mechanical force on the second component, thus causing the fiber to curl or straighten.

In a second aspect, this invention provides a yarn comprising a fiber which is an article according to the first aspect of the invention.

In a third aspect, this invention provides a fabric or other fibrous mass comprising a plurality of fibers, each of which is an article according to the first aspect of the invention. In one embodiment of this aspect of the invention, the thermal insulation of the fabric (or other fibrous mass) increases as the ambient temperature falls (and correspondingly decreases as the ambient temperature rises), for example over at least one temperature range within the bioeffective range of −40 to 50° C.

In a fourth aspect, this invention provides a method of making an article according to the first aspect of the invention, the method comprising melt shaping first and second polymeric compositions as defined in the first aspect of the invention to form an article according to the first aspect of the invention.

DETAILED DESCRIPTION OF THE INVENTION

In the Summary of the Invention above and in the Detailed Description of the Invention, the Examples, and the Statements below, reference is made to particular features (including method steps) of the invention. It is to be understood that the disclosure of the invention in this specification includes all appropriate combinations of such particular features. For example, where a particular feature is disclosed in the context of a particular aspect, embodiment or Example of the invention, or a particular Statement, that feature can also be used, to the extent appropriate, in combination with and/or in the context of other particular aspects and embodiments of the invention, and in the invention generally.

The term "comprises" is used herein to mean that other ingredients, steps etc. are optionally present. The term "at least" followed by a number is used herein to denote the start of a range beginning with that number (which may be a range having an upper limit or no upper limit, depending on the variable being defined). For example "at least 1" means 1 or more than 1, and "at least 80%" means 80% or more than 80%. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)", this means a range whose lower limit is the first number and whose upper limit is the second number. For example, "from 8 to 20 carbon atoms" or "8-20 carbon atoms" means a range whose lower limit is 8 carbon atoms, and whose upper limit is 20 carbon atoms.

In describing and claiming the invention below, the following abbreviations, definitions, and methods of measurement (in addition to any already given) are used. Parts and percentages are by weight, except where otherwise stated; temperatures are in degrees Centigrade, and molecular weights are weight average molecular weights expressed in Daltons. For crystalline polymers, the abbreviation $T_o$ is used to mean the onset of melting, the abbreviation $T_p$ is used to mean the crystalline melting point, and the abbreviation ΔH is used to mean the heat of fusion. $T_o$, $T_p$ and ΔH are measured by means of a differential scanning calorimeter (DSC) at a rate of 10° C./minute and on the second heating cycle. $T_o$ and $T_p$ are measured in the conventional way well known to those skilled in the art. Thus $T_p$ is the temperature at the peak of the DSC curve, and $T_o$ is the temperature at the intersection of the baseline of the DSC peak and the onset line, the onset line being defined as the tangent to the steepest part of the DSC curve below $T_p$. The abbreviation $T_g$ is used to mean glass transition temperature. The term "(meth)acrylate" is used herein to mean acrylate or methacrylate.

The term "fiber" is used herein to denote any article having one dimension which is substantially greater than the other two dimensions, including in particular continuous filaments, staple fibers, and fibrils. The term "equivalent diameter" is used herein to denote the diameter of a circle having the same area as a cross-section of a fiber. The term "fibrous mass" is used herein to denote any assembly of fibers, including but not limited to continuous filament yarns (which may be twisted, untwisted or interlaced), staple fiber yarns, tows, and fabrics. The term "fabric" is used herein to denote any type of fabric, including but not limited to, non-woven fabrics, spun-bonded fabrics, woven fabrics, knitted fabrics, fleeces, and pile fabrics. The term "volume expansion" is used herein to denote the percentage increase in volume of the component as it is heated from the defined lower temperature ($T_p$) to the defined higher temperature ($T_o$). The volume expansion is reversible on cooling, though it may not be fully reversible because of hysteresis effects.

Articles

The articles of the invention may consist of the two components defined above, or may include one or more additional components. Any additional component may be composed of a polymeric or non-polymeric material, for example glass, metal, silicon or wood, but its dimensions and position must be such that it permits (though it may increase or decrease or otherwise modify) a change in shape which results from the volume expansion or contraction of the first component. For example, the additional component may be a thin flexible sheet or wire, or a relatively rigid member substantially at right angles to the principal direction of expansion and contraction. The additional component, if present, can contact only one or both of the defined components and can be placed so that the defined components contact each other directly or are separated from each other, over part or all of the area of overlap, by the additional component.

The article can contain an additional component which comprises an electroactive, electro-optical or non-linear optical polymer, for example polyacetylene, polydiacetylene, polypyrrole, polyphenylene vinylene, polythiophene, polyisothianaphthene or polyaniline. When the additional component comprises such a polymer, the increase or reduction in stress caused by the change in shape of the article can also change the electro-active, electro-optical or non-linear optical properties of the additional component, and the change in those properties can be used to provide (or to induce) an indicating and/or switching function.

The article can contain an additional component within which heat can be generated in order to cause the article to change shape. For example, an additional component of this type can comprise a resistance element (composed, for example, of metal or a polymer having conductive particles dispersed therein) and means for passing an electric current through the resistance element, or can be composed of a material within which heat can be generated by induction heating.

The defined components, and any additional component(s), are preferably bonded to each other (e.g. in the case of polymeric components by melt bonding) so that the components remain in contact with each other when the article changes shape. However, it is also possible for the components to be bonded together in such a way that they separate from each other over part or all of the contacting surfaces when the article changes shape, or after the article has changed shape one or more times.

This invention is particularly useful when the articles of the first aspect of the invention are fibers, and the invention will chiefly be described with reference to fibers. However, the invention includes any article having a temperature-dependent shape which results from the overlapping of first and second components as defined above. For examples of such fibers and other articles (but making use of other overlapping components), reference should be made to the U.S. patents incorporated herein by reference, for example the sections entitled Applications and Methods of Use in columns 15-17 of U.S. Pat. No. 6,388,043. However, it should be noted that U.S. Pat. No. 6,388,043 states that the "shape memory effect" of the articles disclosed therein "is not a specific bulk property, but results from the polymer's structure and morphology".

In the fibers of the invention, each of the defined components extends longitudinally along the fiber. Often, at least one, and preferably both, of the defined components extends along the whole length of the fiber. The cross-section of the fiber, which can be solid or hollow, is generally the same along the whole length of the fiber. However, the cross-section can vary. Preferably both of the defined components extend along the whole length of the fiber. In one embodiment, each of the defined components provides part of the surface of the fiber; for example the components are in the form of strips in a side-by-side configuration. In another embodiment, one of the defined components surrounds the other defined component, with the other component being placed within the surrounding component in an eccentric sheath-core arrangement such that the off-center component can exert sufficient force on the other component(s) to cause the desired change in shape.

In one embodiment of the invention, a plurality of fibers of the invention provide the whole or part of a structure whose thermal insulation properties change as the temperature varies from a temperature above $T_p$ to a temperature below $T_o$, and vice versa. The fibers can be, but are not necessarily, randomly oriented with respect to each other. The structures can for example contain 10 to 100%, e.g. 10 to 70% or 20 to 50%, of the novel fibers. The remainder (if any) of the structure is composed of other articles which do not prevent, and preferably do not substantially suppress, the shape change of the novel fibers. The other articles can for example be other fibers, for example polymeric fibers, e.g. five is comprising a polyamide, polyester, polyolefin or cellulosic polymers, including, but not limited to, the polymers described below for the second composition. The other fibers can optionally be crimped or otherwise bulked. The structures of this kind are particularly useful when the thermal insulation properties change within the temperature range to which human beings may be subject, for example between −40° C. to 50° C., which may be referred to as the bio-effective range, especially within the temperature range of the atmosphere, for example from −30° C. to 40° C. Such structures can usefully form part of protective coverings, whose thermal insulation properties adapt to changes in ambient temperature. Such protective coverings include, for example, clothing for human beings.

In a preferred example of this embodiment, at least some, and preferably all, of the fibers, in the absence of any restraint, are relatively straight at a temperature greater than $T_p$. In the "relatively straight" fibers used in this example, preferably it is possible to draw a straight line which remains within the cross-section of fiber and whose length is at least 6 times, preferably at least 10 times, the equivalent diameter of the fiber. If the fiber is not substantially straight, the first component is preferably placed so that shrinkage thereof increases the existing curvature of the fiber. Cooling such fibers to a temperature $T_o$ or below causes the fibers to crimp, because the decrease in temperature causes the crystalline polymer of the first component to crystallize and the volume of the first polymeric composition to decrease more than the volume of the second polymeric composition. The crimping of the fibers causes the structure (yarn, fabric or other fibrous mass) to expand and creates additional air spaces within the structure, which in turn increases its thermal insulation properties. If the structure contains fibers of the invention of more than one kind, the fibers differing from each other in the $T_p$ of the crystalline polymer in the first polymeric composition, then there will be a progressive stepwise increase in the insulation properties of the structure as the temperature decreases, as the fibers of the different kinds are in turn converted from a straight to a crimped configuration.

The invention includes, as one embodiment of the fourth aspect of the invention, a method of producing a mixture of such fibers of different kinds, the method comprising melt extruding two more first compositions and one or more second compositions to form such fibers. Preferably, the extrusion operation is coordinated, optionally through one or more multi-orifice spinnerets, so as to produce in a single operation a mixture of fibers that can then be incorporated into a fibrous product. Multi-component dies as described in U.S. Pat. Nos. 6,395,392 and 5,972,502 can be used to prepare bi-components and multicomponent filaments and articles.

A similar progressive step wise increase in the insulation properties of the structure can be achieved by using fibers which contain two or more first components, the polymeric compositions in the different first components containing crystalline polymers having different $T_p$s. Similar results can also be achieved by using as the crystalline polymer in a block copolymer comprising two or more different crystalline blocks having different $T_p$s. For example, the structure may contain fibers of the invention in which the $T_p$ of the crystalline polymer(s) in the first polymeric composition is selected from one or more of the ranges 20 to 30° C., 10 to 20° C., 0 to 10° C., −10 to 0° C., −20 to −10° C., −30 to −20° C., and −40 to −30° C.

When the temperature of the structure is increased from below $T_o$ to $T_p$ or above, the crystalline polymer melts and the fibers tend to return towards their original straight configuration. However, entanglement of the fibers as the result of the earlier crimping may limit, or in some cases entirely prevent, the return to the straight configuration. Hysteresis effects may also limit the return to the straight configuration.

In another example of this embodiment, at least some, and preferably all, of the fibers, in the absence of any restraint, are not straight at a temperature greater than $T_p$. (for example it is not possible to draw a straight line which remains within the cross-section of fiber and whose length is at least 10 times the equivalent diameter of the fiber), and the first component is placed so that shrinkage thereof reduces the existing curvature of the fiber. Cooling such fibers from a temperature above $T_p$ to a temperature below $T_o$ reduces or removes the curvature of the fibers. The information given above for the preferred example of this embodiment of the invention applies equally to this example, except that the crystallization and melting of the crystalline polymer produce an opposite effect on the shape of the fiber, and the thermal insulation properties of the structure containing them.

Crystalline Polymers

The crystalline polymers used in this invention preferably have a peak melting temperature $T_p$ which is chosen such that the article changes shape over a desired temperature range. When the article is a fiber which is, or will be, part of a fabric or other fibrous body whose insulating properties change as the temperature drops, $T_p$ may be at least −40° C., for example at least −20° C., and at most 60° C., for example at most 40° C. or at most 15° C. The smaller the value of $(T_p-T_o)$, the more rapid the change in shape as the temperature changes between $T_p$ and $T_o$. For the polymers of interest, minimum values of $(T_p-T_o)$ tend to occur in the region 0-20° C. In some examples of the invention, when $T_p$ is greater than 48° C., $(T_p-T_o)$ is less than $T_p^{0.7}$ and when $T_p$ is less than 48° C., $(T_p-T_o)$ is less than 15° C., for example less than 12° C. When $T_p$ is 10 to 20° C., $(T_p-T_o)$ is preferably less than 15° C.; when $T_p$ is 0 to −10° C., $(T_p-T_o)$ is preferably less than 12° C.; when $T_p$ is −10 to −20° C., $(T_p-T_o)$ is preferably less than 15° C.; and when $T_p$ is −20 to −40° C., $(T_p-T_o)$ is preferably less than 20° C. The crystalline polymer has a heat of fusion of at least 5 J/g, preferably at least 10 J/g or at least 15 J/g, for example 5-50 J/g, preferably 20-40 J/g. The crystalline polymer may be for example a homopolymer; a random copolymer of one or more monomers; a block copolymer in which one of the blocks is crystalline and the other block(s) is (are) crystalline or amorphous; or a core-shell polymer in which the core is composed of a crystalline polymer and the shell surrounding the crystalline polymer is composed of an amorphous polymer, or vice versa.

The molecular weight of the crystalline polymer is preferably at least 20,000 Daltons, particularly at least 50,000 Daltons, especially at least 100,000 Daltons. When the crystalline polymer is cross-linked, its molecular weight before being cross-linked is preferably at least 5000 Daltons, particularly at least 10,000 Daltons, especially at least 25,000 Daltons.

Side Chain Crystalline (SCC) Polymers

The crystalline polymer is preferably a side chain crystalline (SCC) polymer. SCC polymers are well known, and are described for example in J. Poly. Sci. 60, 19 (1962), J. Poly. Sci. (Polymer Chemistry) 7, 3053 (1969), 9, 1835, 3349, 3351, 3367, 10, 1657, 3347, 18, 2197, 19, 1871, J. Poly. Sci., Poly Physics Ed 18 2197 (1980), J. Poly. Sci. Macromol. Rev. 8, 117 (1974), Macromolecules 12, 94 (1979), 13, 12, 15, 18, 2141, 19, 611, JACS 75, 3326 (1953), 76, 6280, Polymer J 17, 991 (1985), Poly. Sci USSR 21, 241 (1979), and U.S. Pat. Nos. 4,380,855, 5,120,349, 5,129,180, 5,156,411, 5,254,354, 5,387,450, 5,412,035, 5,469,869, 5,665,822, 6,199,318 and 6,255,367. The disclosure of each of these publications is incorporated herein by reference. As disclosed in those publications, the backbone portion of the SCC polymer can for example be a polyacrylate, poly-methacrylate, polyamide, polyester, polyurethane, polysiloxane, polyolefin, polyether, polyphosphazene, or polystyrene backbone.

The SCC polymer, or the SCC block of a block copolymer, or the SCC polymer core or shell of a core-shell polymer, can for example contain at least 30%, preferably at least 40%, for example 30-90%, preferably 40-80%, particularly 50-70%, of units derived from (1) at least one n-alkyl acrylate or methacrylate (or equivalent monomer, for example an acrylamide or methacrylamide) in which the n-alkyl group contains at least 8, for example 8-50, particularly 8-22, carbon atoms, and/or (2) at least one substantially fluorinated n-alkyl acrylate or methacrylate (or equivalent monomer, for example an acrylamide or methacrylamide) in which the fluorinated n-alkyl group contains at least 6, for example 6-20 carbon atoms, the number of carbon atoms in the n-alkyl or fluorinated n-alkyl group or groups being selected to provide than SCC polymer with the desired melting point. For example, polymers based on dodecyl acrylate and/or tetradecyl acrylate can provide SCC polymers having melting points between about 0° C. and 20° C. The other units, if any, in the SCC polymers can, for example, be derived from other comonomers containing one or more ethylenic double bonds, and can be selected to modify the physical and/or chemical properties of the SCC polymer, for example its interfacial reaction with other polymeric or non-polymeric components Examples of comonomers containing a single ethylenic double bond include other alkyl (meth)acrylates (or equivalent monomers, such as acrylamides or methacrylamides) in which the alkyl groups may be straight or branched chain, e.g. butyl acrylate; alkyl (meth)acrylates in which the alkyl groups (which may be straight or branched chain) are substituted by polar groups, for example hydroxyl or carboxyl groups, e.g. hydroxyethyl (meth)acrylate; hydroxypropyl (meth)acrylate; hydroxy butyl (meth)acrylate; acrylic acid; methacrylic acid; acrylonitrile; styrene; anhydrides, e.g. maleic anhydride; monomers containing glycidyl groups, e.g. glycidyl methacrylate; monomers containing sulfonic acid groups, e.g. 2-acrylamido-2-methylpropane sulfonic acid and styrene sulfonic acid; and dimethylaminoethyl (meth)acrylate. The percentage of units derived from such monounsaturated comonomers may be at least 10%, for example at least 20%. The percentage of units derived from such comonomers containing polar groups may be less than 50%, for example less than 25%.

Non-SCC Crystalline Polymers

The crystalline polymer in the first component can alternatively be a main chain crystalline polymer. Examples of main chain crystalline polymers that may be used with melt transitions within the bioeffective temperature range include but are not limited to the following polymers, whose $T_p$s may be for example as shown in parentheses after the chemical name of the polymer:

poly-octamethylene-1-methyl (−5° C.)
1,4-poly-1,3-butadiene(cis) (1-6° C.)
1,4-poly-1,3-butadiene-2-methyl(cis) (14-36° C.)
polysiloxane-diethyl (17° C.)
polysiloxane-dimethyl (−40° C.)
poly-11-aminoundecanoic acid-N-ethyl (−30° C.)
poly-11-aminoundecanoic acid-N-phenyl (−30° C.)
polyhexamethylene glutaramide-N,N-dibutyl (20° C.)
polyhexamethylene glutaramide-N,N-diethyl (5° C.)
polyhexamethylene glutaramide-N,N-diisopropyl (20° C.)
polyhexamethylene glutaramide-N,N-dimethyl (30° C.)
1,2-poly-1,3-pentadiene trans syndiotactic (10° C.)
polypentamethylene adipamide-2,2,3,3,4,4-hexafluorodiamine-N,N-dibutyl (15° C.)
polypentamethylene adipamide-2,2,3,3,4,4-hexafluorodiamine-N,N-diethyl (20° C.).

The first polymeric composition should have adequate physical properties at the expected temperatures of use, for example within the temperature range of −40 to 50° C. when the article is in the form of a fabric having temperature-dependent thermal insulation properties. If the first polymeric composition is exposed on the surface of the article, then there is a danger that at temperatures greater than $T_o$, particularly at temperatures greater than $T_p$, the composition will become tacky, or even flow. This potential problem can be controlled by various measures that restrict the mobility of the molten composition, including for example the use of a crystalline polymer having a sufficiently high molecular weight, the use of a crosslinked crystalline polymer, the use of a block copolymer containing crystalline polymer blocks, or the presence of an interpenetrating polymer network. Preferably, the first composition, at 10° C. above the $T_p$ of the crystalline polymer therein (or, if there is more than one crystalline polymer, above the $T_p$ of the highest melting crystalline polymer), has a tack value, measured by ASTM D2979, of less than 25, more preferably less than 20, particularly less than 15, especially less than 10, g·cm/sec. If the first component, containing the crystalline polymer, is surrounded by another component of the article, such expedients can be used, but may not be necessary.

Crosslinked SCC polymers can be obtained through the use of comonomers containing two or more, preferably two, ethylenic double bonds. The percentage of units derived from such crosslinking comonomers may be at most 5%, for example 0.3-3%, preferably 0.7-1.5%. Suitable crosslinking monomers include diacrylates and dimethacrylates, e.g. 1,6-hexanediol diacrylate, tripropyleneglycol diacrylate, 1,3-butyleneglycol dimethacrylate, trimethylolpropane triacrylate and polyethylene glycol 200 diacrylate; divinyl compounds, e.g. divinyl benzene; and diallyl compounds, e.g. dodecanedioic acid diallyl ester.

Crosslinking can also be effected through the use of comonomers having a single ethylenic double bond and another suitable functional group (for example a functional group which reacts when exposed to moisture or to selected radiation, for example ultraviolet radiation), for example ethylenically unsaturated silanes such as 3-methacryloxypropyl trimethoxysilane, 3-glycidoxypropyltrimethoxy silane and N-(2-aminoethyl)-3-aminopropyltrimethoxy silane; and TMI (an unsaturated aliphatic monoisocyanate) available from Cytec.

In one embodiment of the invention, the crosslinking is effected by means of a crosslinking agent which does not cause crosslinking of the SCC polymer while it is being processed into a fiber, but can be activated (for example by ultraviolet radiation) to cause crosslinking after the fiber has been prepared.

In one embodiment, the SCC polymer is the core of a core/shell product, preferably of the kind referred to in U.S. Pat. No. 6,199,318 B1.

First Polymeric Compositions

The first polymeric composition comprises the defined crystalline polymer. It can consist of one or more of the defined crystalline polymers, or can also contain one or more additional polymeric or non-polymeric ingredients. Often the first polymeric composition contains at least 60%, for example at least 80%, of the defined crystalline polymer(s). When an additional polymeric ingredient is present, it may be, for example, a copolymer which improves the physical and/or chemical properties of the composition. For example, an ethylene/vinyl acetate copolymer may be used to improve the toughness and/or flexibility of the composition. When a non-polymeric ingredient is present, it may be, for example, a low molecular weight oligomer or a plasticizer which improves the physical and/or chemical properties of the composition, for example its ability to adhere to, or otherwise interact with, the other component(s) of the article. The first polymeric composition can also contain an additional ingredient which makes it possible to heat the first component, for example by passing electric current through the component or by generating heat by induction heating.

Second Compositions

The second composition is different from the first polymeric composition, and, between the $T_o$ and $T_p$ of the crystalline polymer in the first polymeric composition, has a lower volume expansion than the volume expansion of the first polymeric composition. Often, the volume expansion of the first polymeric composition will be at least 2 times, for example at least 3 or at least 5 times, and maybe more times, for example at least 10 times or at least 20 times, e.g. 3-10 times or 3-20 times, the volume expansion of the second composition over that temperature range The second composition is often a second polymeric composition, and the invention will chiefly be described by reference to second compositions which are polymeric compositions. However, the invention includes articles in which the second composition is non-polymeric, for example comprises one or more metals (including alloys) or silicon. Particularly when the second component is composed of a non-polymeric composition, or a relatively rigid polymeric composition, care may be needed to ensure that the dimensions, shape and positioning of the second component are such that the second component can be deformed, or does not need to be deformed, in order for the thermal expansion or contraction of the first component to produce the desired change in shape of the article. Those skilled in the art will have no difficulty, having regard to their own knowledge, and the disclosure herein, in selecting suitable dimensions and shapes for the second component.

When the second composition is a polymeric composition, the second component is preferably prepared by melt-shaping for example melt-extruding, the second polymeric composition. The second polymeric composition may for example comprise one or more of the multitude of crystalline and noncrystalline homopolymers and copolymers conventionally used in the preparation of fibers, for example a polyamide, e.g. nylon-6, nylon-6,6 or nylon-6,10; a polyester, e.g. polyalkylene terephthalates, including polyethylene terephthalate; a polyolefin, e.g. polyethylene, polypropylene, polybutene, poly-4-methylpentene, an ethylene-propylene rubber or polystyrene; an acrylic or methacrylic polymer, e.g. a polyalkyl (meth)acrylate, including polymethyl (meth)acrylate, polyethyl (meth)acrylate, polypropyl (meth) acrylate, polybutyl (meth)acrylate, polyhexyl (meth)acrylate, and polyoctyl (meth)acrylate; or a polyacrylamide; a polyurethane; a polyvinyl halide or polyvinylidene halide, e.g. polyvinyl chloride; polytetrafluoroethylene; a polycarbonate; a polyacetate; a polyphenylene ether; a polyphenylene oxide; a polyvinyl acetate; a polyphosphazene; a polyalkylene glycol; a polyalkylene oxide; a polysiloxane; a polyvinyl pyrrolidone; regenerated cellulose; an elastomer; or a thermoplastic elastomer. For further details of such polymers, reference may be made for example to the U.S. patents incorporated by reference herein.

The second polymeric composition can also comprise an electroactive, electro-optical or non-linear optical polymer, for example polyacetylene, polydiacetylene, polypyrrole, polyphenylene vinylene, polythiophene polyisothianaphthene or polyaniline. When the second polymeric composition comprises such a polymer, the increase or reduction in stress caused by the change in shape of the article will also change the electro-active, electro-optical or non-linear optical properties of the second component, and the change in those properties can be used to provide (or to induce) an indicating and/or switching function.

The second polymeric composition can contain two or more polymers. It can also contain non-polymeric components.

In some embodiments of the invention, the second polymeric composition contains a polymer which is compatible with the first polymeric composition, to enhance the bond between the first and second components. Where the first polymeric composition is crosslinked after the fiber has been formed, the second polymeric composition can be such that crosslinks are formed between the first and second polymeric compositions.

In some embodiments of the invention, the second polymeric composition comprises a crystalline polymer which falls within the definition given above for the crystalline polymer in the first component, but which has an onset of melting temperature $T_o$ which is higher, preferably at least 10° C. higher, particular least 20° C. higher, than the $T_p$ of the crystalline polymer in the first component.

The second polymeric composition can also contain an ingredient which makes it possible to heat the first component, for example by passing electric current through the component or by generating heat by induction heating.

Preparation of the Articles of the Invention

Those skilled in the art will have no difficulty, having regard to their own knowledge and the disclosure herein, in preparing the articles of the first aspect of the invention, and the yarns and fibrous masses of the second and third aspects of the invention. The fibers can be prepared by coextruding the first and second polymeric compositions through an orifice which provides the desired juxtaposition of the compositions in the extruded fiber. The continuous filaments so produced can be treated by known techniques, including their conversion into crimped filaments and/or staple fibers, multi-filament yarns, and a wide variety of fibrous masses. The fibers and fibrous masses containing them can be treated by known methods to induce additional thermal responses.

The invention is illustrated by the following Example.

EXAMPLE

A 1 mil thick polyethylene terephthalate (PET) film was cut into strips 12 inch×0.5 inch. Some of the strips were coated with an SCC polymer having a $T_p$ of 28° C. One of the strips was coated with a standard pressure sensitive adhesive (PSA) that did not have a $T_p$ within the temperature range −30 to 40° C. The coated strips and an uncoated control strip were flat at room temperature. The coated strips and the control strip were placed in a freezer at −26° C. The long edges of each strip coated with the SCC polymer rose by about 0.125 inch, and one end of each strip rose by 1 to 4 inches (up to about a 40 degree angle). The strip coated with the PSA curled slightly in the width direction, but did not change its lengthwise configuration. The uncoated control strip did not change shape.

The invention claimed is:

1. An article comprising (1) a first component composed of a first polymeric composition, the first polymeric composition comprising a side chain crystalline polymer which has (a) a peak melting temperature $T_p$ which is −20 to 40° C., (b) an onset of melting temperature $T_o$ such that $(T_p-T_o)$ is less than $$(-1.7757e^{-5})\times(T_p^3)+(3.339e^{-3})\times(T_p^2)-(6.977e^{-2})\times(T_p)+k,$$

where k is 16, and (c) a heat of fusion of at least 5 J/g;

and (2) a second component which (a) is composed of a second composition, and (b) overlaps the first component;

the first polymeric composition having a volume expansion between $T_o$ and $T_p$ which is greater than the volume expansion of the second composition over the same temperature range, and the first and second components having dimensions and shapes such that the article, in the absence of external restraint, changes shape when it is heated from $T_o$ to $T_p$ and when it is cooled from $T_p$ to $T_o$.

2. An article according to claim 1 wherein the first polymeric composition has a volume expansion between $T_o$ and $T_p$ which is at least 5 times the volume expansion of the second composition over the same temperature range.

3. An article according to claim 1 wherein the first polymeric composition has a volume expansion between $T_o$ and $T_p$ which is 3 to 10 times the volume expansion of the second composition over the same temperature range.

4. An article according to claim 1 wherein the first polymeric composition contains at least 80% of the side chain crystalline polymer.

5. An article according to claim 1 wherein k is 11.

6. An article according to claim 1 wherein the first polymeric composition contains at least two said side chain crystalline polymers having $T_p$s which differ by a least 10° C.

7. An article according to claim 1 which is a fiber which is relatively straight at temperatures above $T_p$ and becomes curved when cooled from a temperature above $T_p$ to a temperature below $T_o$.

8. An article according to claim 7 wherein the first and second components are in a configuration selected from side-by-side configurations and eccentric core-sheath configurations.

9. An article according to claim 7 which is a continuous filament having a constant cross section throughout its length.

10. A yarn comprising a fiber as defined in claim 7.

11. A method of making an article as defined in claim 1 which comprises coextruding first and second polymeric compositions as defined in claim 1.

12. A fibrous mass comprising a plurality of fibers each of which comprises a first component composed of a first polymeric composition, the first polymeric composition comprising a side chain crystalline polymer which has (a) a peak melting temperature $T_p$ which is −20 to 40° C.

(b) an onset of melting temperature $T_o$ such that $(T_p-T_o)$ is less than $$(-1.7757e^{-3})\times(T_p^3)+(3.339e^{-3})\times(T_p)-(6.977e^{-2})\times(T_p)+k,$$

where k is 16, and (c) a heat of fusion of at least 5 J/g;

and a second component which (a) is composed of a second polymeric composition, and (b) overlaps the first component;

the first polymeric composition having a volume expansion between $T_o$ and $T_p$ which is at least 5 times the volume expansion of the second composition over the same temperature range, and the first and second components having dimensions and shapes such that the fibrous mass, in the absence of external restraint, changes shape when it is heated from $T_o$ to $T_p$ and when it is cooled from $T_p$ to $T_o$.

13. A fibrous mass according to claim 12 wherein the first polymeric composition contains at least 80% of the side chain crystalline polymer.

14. A fibrous mass according to claim 12 wherein the fibers are relatively straight at temperatures above $T_p$ and becomes curved when cooled from a temperature above $T_p$ to a temperature below $T_o$.

15. A fibrous mass according to claim 14 wherein the first and second components are in a side-by-side configuration.

16. A fibrous mass according to claim 12 wherein the side chain crystalline polymer is cross-linked.

17. A fibrous mass according to claim 12 which contains 10 to 50% of said fibers and 90 to 50% of other fibers.

18. A fibrous mass according to claim 12 which is part of clothing for a human being.

* * * * *